US008798494B1

(12) United States Patent
Teng

(10) Patent No.: US 8,798,494 B1
(45) Date of Patent: Aug. 5, 2014

(54) FILTER ON TOP OUTPUT BIN OF A PRINTER

(71) Applicant: Ruei-Ching Teng, Tainan (TW)

(72) Inventor: Ruei-Ching Teng, Tainan (TW)

( * ) Notice: Subject to any disclaimer, the term of this patent is extended or adjusted under 35 U.S.C. 154(b) by 43 days.

(21) Appl. No.: 13/778,138

(22) Filed: Feb. 27, 2013

(51) Int. Cl.
*G03G 21/00* (2006.01)
*G03G 21/20* (2006.01)

(52) U.S. Cl.
CPC ..... *G03G 21/20* (2013.01)
USPC ..... 399/93; 399/98

(58) Field of Classification Search
USPC ..... 399/91–93, 98
See application file for complete search history.

(56) References Cited

U.S. PATENT DOCUMENTS

| | | | | |
|---|---|---|---|---|
| 7,269,372 | B2 * | 9/2007 | Kim et al. | 399/93 |
| 7,486,904 | B2 * | 2/2009 | Sato et al. | 399/92 |
| 8,139,995 | B1 * | 3/2012 | Fujita et al. | 399/390 |

* cited by examiner

*Primary Examiner* — Hoan Tran

(57) ABSTRACT

A filter on top output bin of a printer is consisted of a box wherein a chamber inside of a box, filtering exit on the top of the box, sealing strips sealed along the edge of the filtering exit, filtering entrance under the box, anti-paper jam strips bored on two literal side of the filtering entrance, and an opening bored on a literal side of the box, a filtering net inside of the box is surrounded by frames, and electrostatic filter attached on the top of the filtering net. The filter can be placed on the top output bin on the printer, or be supported the box by having flexible holder adapted to a variety printer. The output papers won't be impacted into the filtering net by having anti-paper jam strips therefore filter can absorb toner emissions and odor so as to clear the air.

5 Claims, 6 Drawing Sheets

FILTER ON TOP OUTPUT BIN OF A PRINTER

BACKGROUND OF THE INVENTION

1. Field of the Invention

The present invention relates to a filter on top output bin of a printer, particularly to a box wherein a chamber is bored inside of the box, a filtering exit is bored on the top of the box, sealing strips are sealed along the edge of the filtering exit, a filtering entrance is bored under the box, anti-paper jam strips are bored on the two literal side of the filtering entrance, and an opening is bored on a literal side of the box; a filtering net wherein is placed inside of the box is surrounded by frames; and an electrostatic filter wherein is attached to the top of the filtering net. The filter can be placed on top output bin of on the printer, or be supported by flexible holder adapted to a variety printer. The output papers won't be impacted into the filtering net by having anti-paper jam strips. Therefore, the filter not only absorbs toner emissions and odor while printing so as to clear the air but also convenience to print out the papers.

2. Description of the Prior Art

Commonly, when papers are been printed by a printer, toner emissions and odor will be emitted from the top output bin of the printer and drifted by heating air so that it will cause the air polluted and harmed to human healthy. Hence, in view of the inconveniences in the prior printer while printing, the inventor of the present invention has conducted extensive research and experiment and finally succeeded in pioneering the subject matter disclosed herein.

SUMMARY OF THE PRESENT INVENTION

The object of this present invention is to offer a filter able to be placed on top output bin of a printer or be supported by flexible holder adapted to a variety printer. Additionally, the output papers aren't able to be impacted into filtering net to cause paper jammed by having anti-paper jam strips. Moreover, the filter on top output bin is able to abort emissions and odor so as to clear air when the printer is printing papers.

A filter on top output bin of a printer is consisted of a box, filtering net and electrostatic filter. The box is provided with a chamber inside of a box, filtering exit on top of the box, sealing strips sealed along the edge of the filtering exit, a filtering entrance under the box, anti-paper jam strips on two literal sides of the filtering entrance, an opening on one literal side of the box. The filtering net placed inside of the chamber of the box is surrounded by frames. The electrostatic filter is attached to the top of the filtering net.

The filter on the top output bin of a printer can be made of paper box wherein the opening of the box is protruded with short folder and long folder.

The filter on the top output bin of a printer is able to be supported by flexible holder wherein is provided with a fixture on the holder's top.

The filtering net of the filter on the top output bin of a printer is made of activated carbon non-woven fabric in wave shape.

The electrostatic net of the filter on the top output bin of a printer is made of electrostatic fabric.

BRIEF DESCRIPTION OF THE DRAWINGS

This invention will be better understood by referring to the accompanying drawings, wherein.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
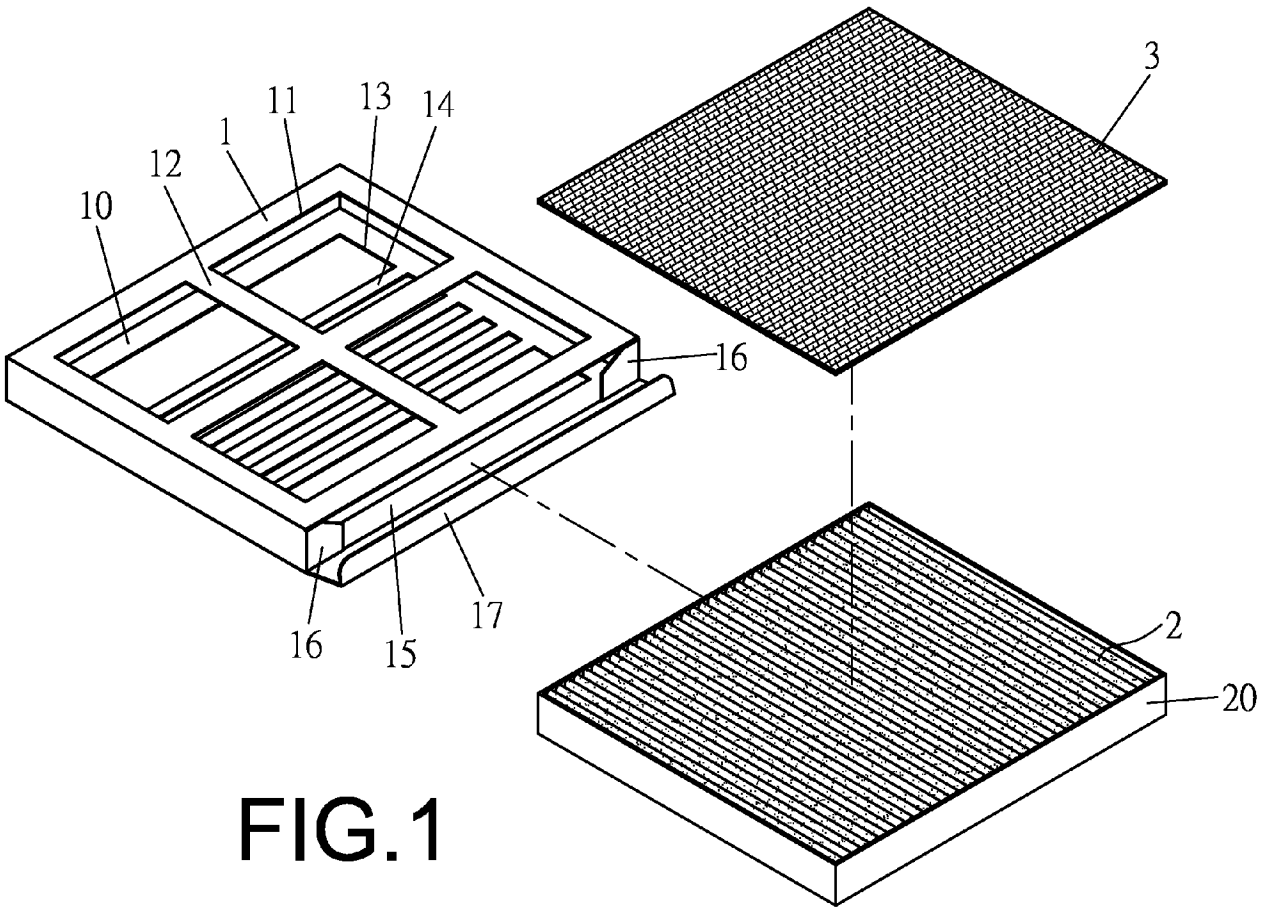
FIG. 1 is an exploded perspective view showing a preferable embodiment of the present invention.

As shown on FIG. 1, a preferable embodiment of the present invention is mainly consisted of a box 1, filtering net 2 and electrostatic filter 3. The box 1 is provided with a chamber 10 inside of the box 1, filtering exit 11 on the top of the box 1, sealing strips 12 sealed around the edge of the filtering exit 11, filtering entrance 13 under the box 1, anti-paper jam strips 14 on the two literal sides of the filtering entrance 13, and an opening 15 on the literal side of the box 1. The box 1 is made of paper and the opening 15 is protruded with short folder 16 and long folder 17. The filtering net 2 is placed inside of the chamber 10 of the box 1, and provided with frames 20 surround the filtering net 2. The filtering net 2 is made of activated carbon non-woven fabric in wave shape. The electrostatic filter 3 is attached to the top of the filtering net 2 and made of electrostatic fabric.

Figure 2:
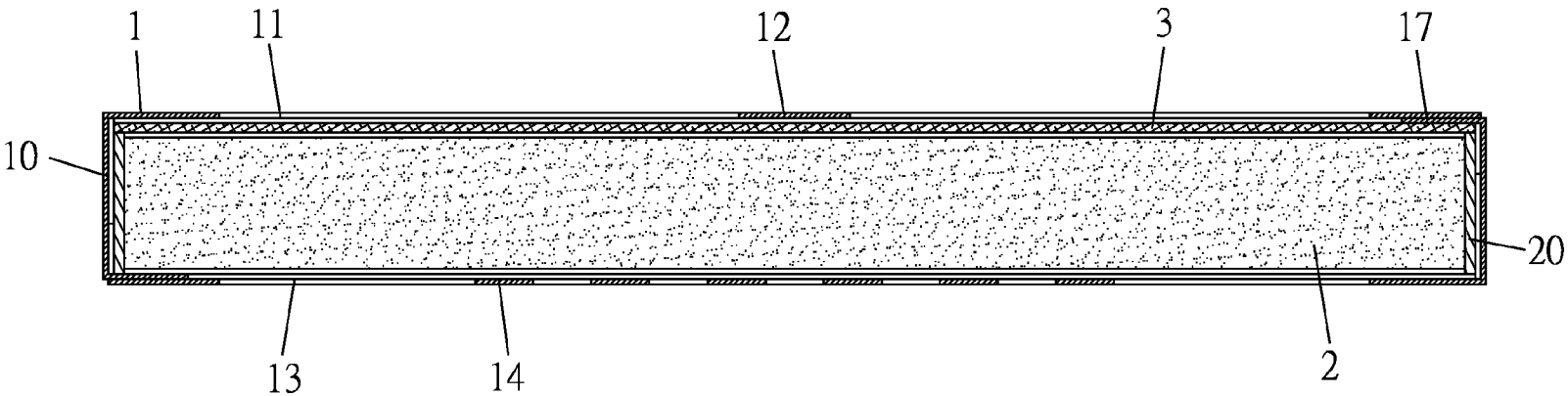
FIG. 2 is a cross-section view showing the assembly of the embodiment of the present invention.
Figure 3:
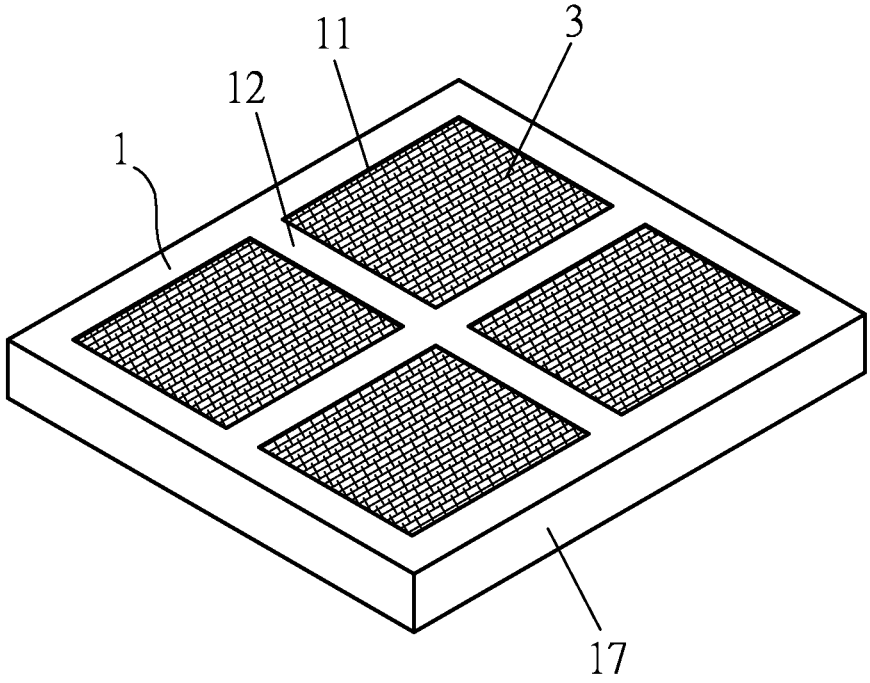
FIG. 3 is a perspective view showing a preferable embodiment of the present invention.

As shown on FIG. 1~3, when assembling, firstly the electrostatic filter 3 is attached to the top of the filtering net 2 and then the filtering net 2 is placed into the chamber 10 of the box 1. After all, the short folder 16 and the long folder 17 are bent as so to close the opening 15 of the box 1. Hence, the assembly is completed.

Figure 4:
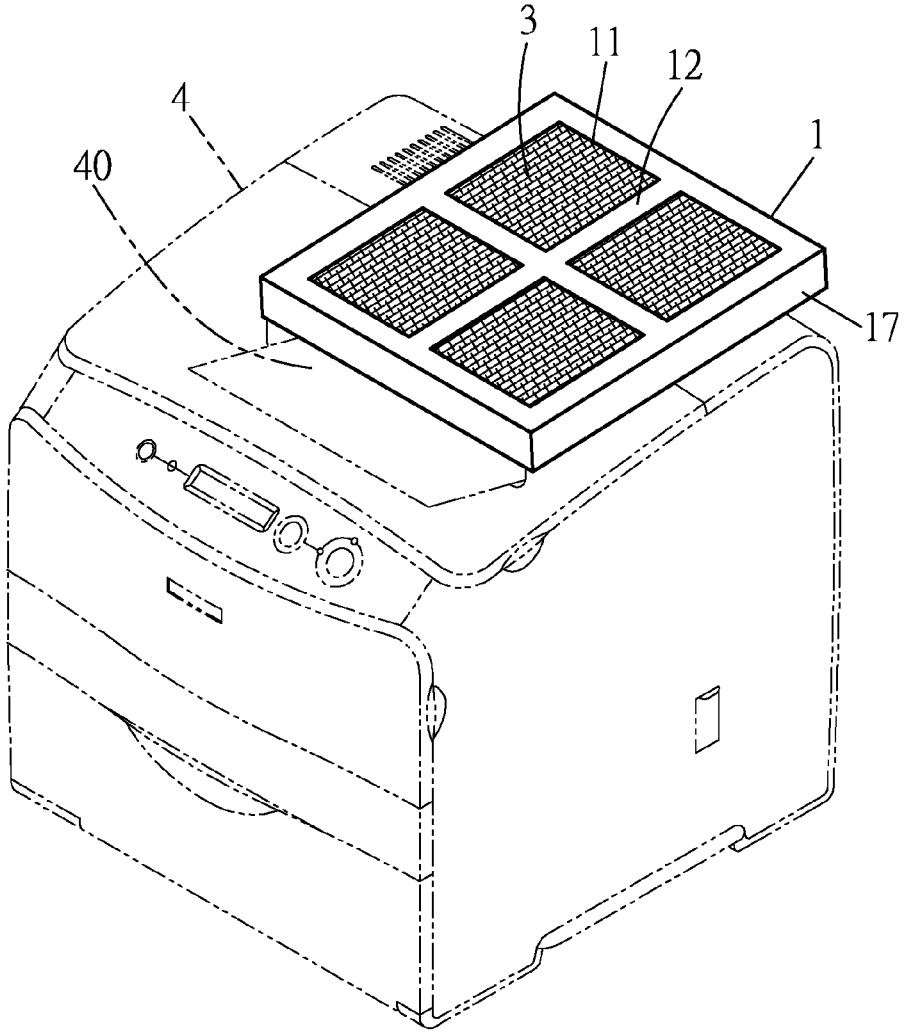
FIG. 4 is a schematic view showing the operation of the embodiment of the present invention being placed on top output bin of a printer.
Figure 5:
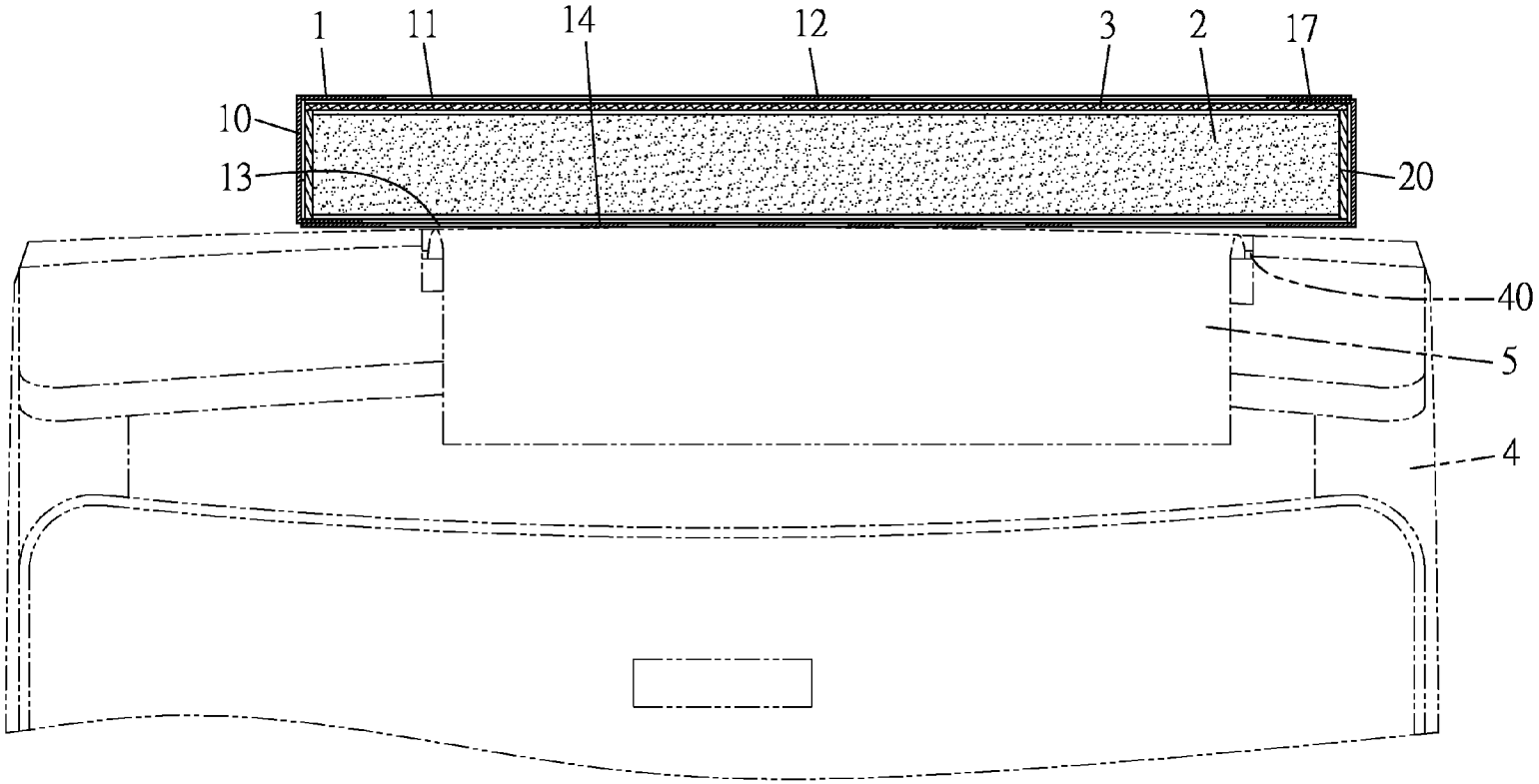
FIG. 5 is a schematic view showing the operation of the embodiment of the present invention being placed on top output bin of a printer.
Figure 6:
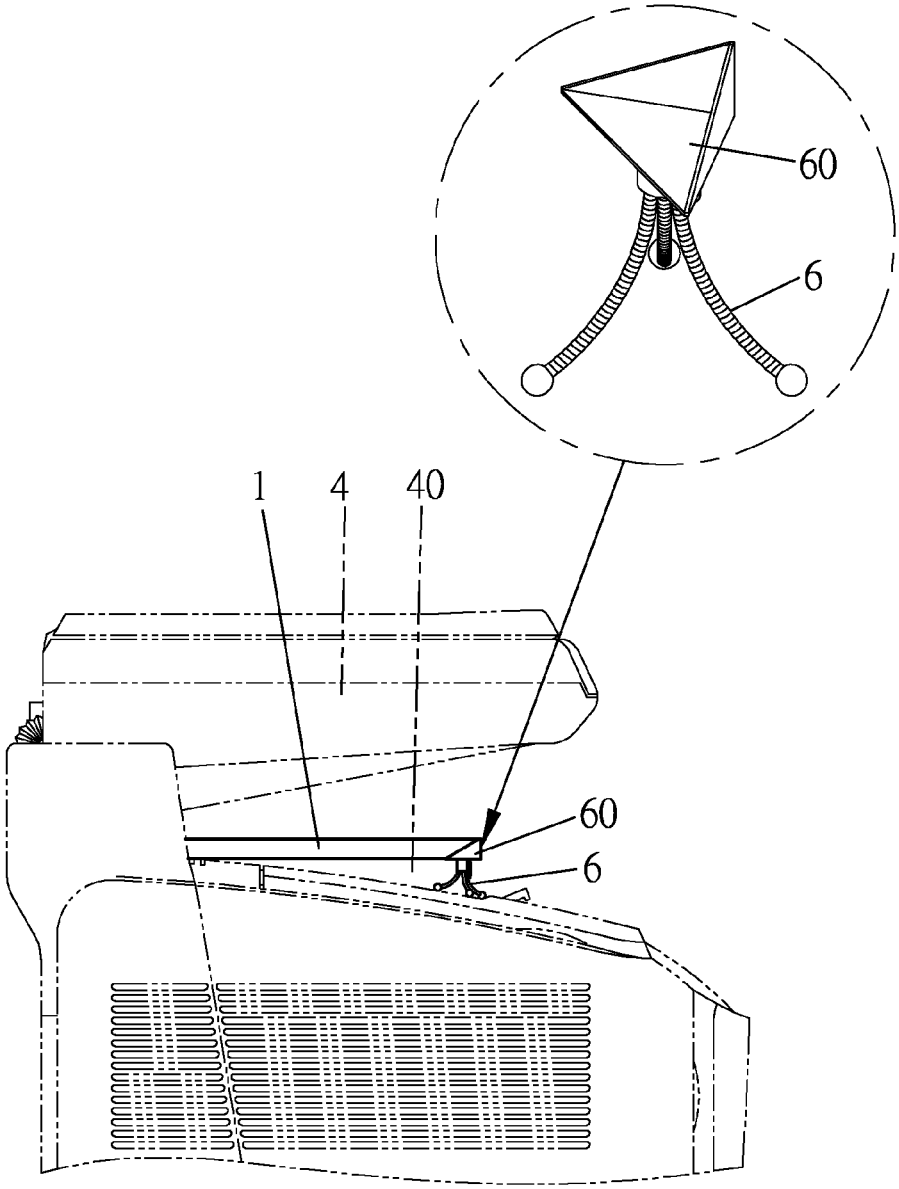
FIG. 6 is a schematic view showing the operation of the embodiment of the present invention being supported by flexible holder with fixture on top output bin of a printer.

As shown on FIG. 4~5, when using, the box 1 can simply be placed on the top output bin 40 of a printer 4. Paper 5 is easily printed out without impacting into filtering net 2 as paper jammed by having anti-paper jam strips 14. Toner emissions occurred by the printer 4 while printing are able to be absorbed by filtering net 2 and electrostatic net 3 and the odor can also be eliminated additionally so that it can avoid harms to human health. Furthermore, as shown on FIG. 5~6, flexible holder 6 is provided to support the box 1 and the top of the flexible holder 6 is provided with a fixture 60 to hold the box 1 in position. The flexible holder 6 can be bent to its' angle in order to reach appropriate height which allows paper 5 easily being printed and exited by printer 4 as so to be adapted to various kinds of different printers 5. In addition, by using anti-paper jam strips 14, the paper 5 can be sliding out without impacting to filtering net 2 to cause paper jammed. The filtering net 2 and the electrostatic filter 3 can absorb the emissions and eliminate the odor while printing to prevent harms to human health at the meantime. Therefore, this present invention can be convenience to print out the paper 5 and clear air simultaneously.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A filter on top output bin of a printer is consisted of:

a box provided a chamber inside of the box, filtering exit on the top of the box, sealing strips sealed along the edge of the filtering exit, filtering entrance under the box, anti-paper jam strips on two literal sides of filtering entrance and an opening on a literal side of the box, filtering net placed inside of the chamber of the box and frames surrounded the filtering net, and electrostatic filter attached to the top of the filtering net.

2. The filter on top output bin of a printer as claimed in claim 1, the box is made of paper and the opening is protruded with short folder and long folder.

3. The filter on top output bin of a printer as claimed in claim 1, the box is provided with flexible holder with a fixture on the top of the holder.

4. The filter on top output bin of a printer as claimed in claim 1, the filtering net is made of activated carbon non-woven fabric in wave shape.

5. The filter on top output bin of a printer as claimed in claim 1, the electrostatic net is made of electrostatic fabric.

* * * * *